US006988428B1

(12) United States Patent
Kathan

(10) Patent No.: US 6,988,428 B1
(45) Date of Patent: Jan. 24, 2006

(54) POWER TONG WITH LINEAR CAMMING SURFACES

(76) Inventor: Murray Kathan, 23013 Township Road 564, Gibbons, Alberta (CA) T0A 1N0

( * ) Notice: Subject to any disclaimer, the term of this patent is extended or adjusted under 35 U.S.C. 154(b) by 0 days.

(21) Appl. No.: 11/181,937

(22) Filed: Jul. 15, 2005

(30) Foreign Application Priority Data

Jul. 16, 2004 (CA) ..... 2475162

(51) Int. Cl.
*B25B 13/50* (2006.01)

(52) U.S. Cl. ..... 81/57.18; 81/57.2; 81/57.34

(58) Field of Classification Search ..... 81/57.15, 81/57.16, 57.18, 57.2, 57.21, 57.33, 57.34
See application file for complete search history.

(56) References Cited

U.S. PATENT DOCUMENTS 4,250,773 A 2/1981 Haynes et al.
4,273,010 A 6/1981 Farr et al.
4,350,062 A 9/1982 Farr et al.
4,437,363 A 3/1984 Haynes
4,445,402 A 5/1984 Farr et al.
4,827,808 A 5/1989 Haynes et al.
5,819,604 A 10/1998 Buck
5,904,075 A * 5/1999 Buck ..... 81/57.18
6,327,938 B1 * 12/2001 Pietras ..... 81/57.33
6,619,160 B1 9/2003 Buck et al.

* cited by examiner

*Primary Examiner*—Jacob K. Ackun, Jr.
(74) *Attorney, Agent, or Firm*—Donald V. Tomkins

(57) ABSTRACT

In a pivoting-jaw power tong, each primary camming surface of the rotary gear has a substantially linear rather than curved configuration. Each primary camming surface forms an acute angle with a radial line extending from the rotary gear centerline to the point where the primary camming surface transitions to its associated neutral recess. Accordingly, the radial distance to a point on any of the primary camming surfaces reduces linearly with increased distance from the neutral recess. Rotation of the rotary gear in either direction away from the neutral position thus results in a linearly progressive reduction in the distance from the center of rotation to the points where the pivoting jaws' cam followers contact the camming surfaces, thus increasing the force exerted by the dies of the jaws upon a tubular disposed within the jaws. This camming surface geometry allows the power tong to automatically adjust for wear in the mechanism such that the contact force between the rollers and the camming surfaces, and the gripping force applied by the dies, will be substantially uniform.

8 Claims, 6 Drawing Sheets

POWER TONG WITH LINEAR CAMMING SURFACES

FIELD OF THE INVENTION

The present invention relates in general to power tongs for gripping oilfield tubulars to facilitate make-up or break-out of threaded connections between tubulars. In particular, the invention relates to pivoting-jaw power tongs having rotary gears with improved camming surface geometry.

BACKGROUND OF THE INVENTION

Power tongs are well known in the field of drilling and servicing oil and gas wells. Drill pipe and production tubing are typically provided in the form of round steel pipe (commonly referred to as tubulars) with threaded ends for connecting tubulars into a drill string or a production string, depending on the operation being conducted. The term "make-up" is commonly used to refer to the process of connecting tubulars to each other (i.e., "making up" a threaded connection), and the term "break-out" refers to the process of disconnecting tubulars (i.e., "breaking out" a threaded connection). Well drilling and well servicing involve both make-up and break-out functions, for a variety of purposes well known in the field.

Make-up or break-out of a threaded joint requires that the tubular on each side of the joint be firmly gripped so that the tubulars can be contra-rotated relative to each other, either clockwise or counterclockwise, to make up or break out the joint as desired. This gripping function is commonly carried out using a power tong on each of the tubulars. Power tongs typically have either sliding jaw assemblies or pivoting jaw assemblies, and the present invention is particularly referable to the pivoting-jaw type. There are numerous known types or models of pivoting-jaw power tongs, but they generally have the common features of a partial-circle (or "C-shaped") rotary gear, the internal surface of which defines a camming surface, and a jaw assembly disposed inside the rotary gear and having two or more cam followers that ride against the camming surface of the rotary gear. The cam followers may be in the form of rollers which turn around suitable axles or pivot pins, or they may be formed integrally with the jaws. The jaw assembly has several (typically four) dies—i.e., elements which are toothed or otherwise adapted for grippingly engaging the circumferential outer surface of a tubular member by effectively biting into the steel surface of the tubular when forced against the tubular. The geometry of the camming surface is adapted such that when the rotary gear is rotated around the jaw assembly, either clockwise or counterclockwise away from a neutral position, the dies are urged into gripping contact with the outer surface of the tubular. When the tubulars on each side of the joint have been thus engaged by respective power tongs, the tongs may be rotated relative to each other in the desired mode, thus making up or breaking out the joint as desired.

One example of a prior art pivoting-jaw power tong is disclosed in Canadian Patent No. 1,125,737 issued on Jun. 15, 1982 to Farr et al. (and corresponding to U.S. Pat. No. 4,350,062). As with typical pivoting-jaw power tongs, the camming surface of the Farr device includes a pair of opposed recesses (or neutral zones) such that when the rotary gear is rotated to a neutral position wherein each cam follower has moved into one of the recesses, the jaws spread apart so as to allow the jaws to receive a tubular. On either side of each recess, the camming surface has a circularly-curved primary camming surface. These primary camming surfaces are configured such that when the rotary gear is rotated in either direction away from the neutral position, each jaw is rotated inward. As rotation of the rotary gear increases, the jaws close on the tubular, causing the dies to bite into the tubular. When the tubular is firmly gripped by the dies, the tubular can be rotated so as to be connected to or disconnected from (as the case may be) another tubular.

The primary camming surfaces of the Farr device have different curvature radii on either side of each recess, and this is considered to have certain advantages over typical prior art pivoting-jaw power tongs in which the same curvature radius is used for all of the primary camming surfaces. However, it has been observed that power tongs with circular primary camming surfaces are prone to reduced effectiveness as the dies, pins, rollers, and/or camming surfaces become worn. In such circumstances, the force with which the dies are urged against the surface of the tubular is not uniform, so the dies grip the tubular with variable effectiveness, and in the worst case a die may grip the tubular with little or no effectiveness at all. In such cases only three of the dies will be effectively gripping the tubular instead of four, and this condition tends to causing warping and/or marking of the tubular. This tends to be a particular problem for the dies located near the pivot points of the jaws.

For the foregoing reasons, there is a need for improved pivoting-jaw power tongs having enhanced capability for reliable and effective gripping engagement of tubular members in cases where dies, pins, rollers, and/or camming surfaces are worn. The present invention is directed to this need.

BRIEF SUMMARY OF THE INVENTION

The present invention addresses this need by providing a pivoting-jaw power tong in which the primary camming surfaces of rotary gear have a novel geometry. Each primary camming surface has a substantially linear configuration, rather than a circularly-curved configuration. More specifically, each primary camming surface is oriented so as to form an acute angle with a radial line extending from the rotary gear to the point where the primary camming surface meets its corresponding neutral recess. By virtue of this geometric configuration, the radial distance to a point on any of the primary camming surfaces reduces, in substantially linear fashion, with increased distance away from the neutral recess. Therefore, increased rotation of the ring gear in either direction away from the neutral position will cause both jaws to rotate further inward, thus increasing the force that the dies on the free ends of the jaws will exert on a tubular being engaged by the apparatus.

The inventor has discovered that when using a power tong having such linearly-configured primary camming surfaces, the dies will engage the tubular with considerably increased uniformity and effectiveness, even when the dies, pins, cam followers (e.g., rollers), and/or camming surfaces are worn. In prior art power tongs with curved camming surfaces (such as in the Farr reference), there is a relatively small "sweet spot" or optimal contact zone on the camming surface corresponding to each cam follower such that each die will exert maximum gripping force on the tubular when the cam followers are at their corresponding sweet spots. This works well when the apparatus is new, without any wear to the various components. All of the cam followers will hit their sweet spots at the same time (i.e., when the rotary gear is in a specific optimal position), because the distance from the rotary gear's center of rotation to the sweet spot is the same for all of the cam followers, the distance from the center of rotation to the face of the cam followers is constant, and the distance from the center of rotation to the die contact surfaces is constant.

Continued use of the power tong inevitably results in wear to the components, however, and a certain amount of "play" develops in the mechanism. This causes changes in the geometrical relationship between the cam followers, dies, and/or camming surfaces, such that the cam followers can no longer hit their sweet spots at the same time. In effect, one or more of the sweet spots become shifted to a different position on the camming surface because of the wear, and the geometric relationship between the sweet spots no longer coincides precisely with the geometric relationship between the cam followers. Even small amounts of play can thus result in reduced gripping force being applied to the tubular at one or more of the dies, such that the tubular is not gripped uniformly.

This undesirable condition cannot be effectively remedied by further rotation of the rotary gear, because the tangential angle between the cam followers and the camming surfaces (which may be referred to as the "tangential contact angle") changes as the cam followers move away from their sweet spots or optimal contact zones on the camming surfaces, due to the fact that the camming surfaces are curved. However, when substantially linear camming surfaces are used, as in the present invention, the tangential contact angle will be substantially the same for all cam followers regardless of the position of the rotary gear, and will not be materially altered by normal operational wear to the various components of the power tong.

In the present invention, the linear camming surfaces are oriented such that the radial distance from the center of rotation to the camming surface decreases in substantially linear fashion as the camming surfaces propagate away from the neutral recesses in the camming surfaces. By virtue of this camming surface geometry, rotation of the rotary gear in either direction away from the neutral position results in a linearly progressive reduction of the distance from the center of rotation to the points where the cam followers contact the camming surfaces, with the rate of reduction varying in proportion to the angular displacement of the rotary gear, regardless of how far the cam followers may be displaced away from the neutral recesses.

The inventor has found that the use of such linear camming surfaces results in a much larger sweet spot corresponding to each cam follower. This camming surface geometry allows the power tong to automatically adjust for wear in the mechanism such that the contact force between the cam followers and the camming surfaces—and, therefore, the gripping force applied by the dies to the tubular—will be substantially constant at all locations.

Accordingly, in one aspect the present invention is a power tong having:

(a) a gear housing defining a central space, and a perimeter opening into said space; and (b) a pair of opposing jaw members disposed within said central space, each jaw member having:

b.1 a pivot end, a free end, an inner side, and an outer side, with said pivot end pivotably mounted to the gear housing, and said free end oriented toward said perimeter opening;

b.2 a pair of dies associated with said inner side; and b.3 a cam follower associated with said outer side;

(c) a rotary gear rotatably mounted within the gear housing, and having:

c.1 a circular perimeter with a plurality of gear teeth;

c.2 an inner surface defining a central space large enough to enclose said jaw members; and c.3 a throat opening in said perimeter;

wherein said inner surface defines:

(d) a pair of opposed neutral recesses; and (e) a first pair of opposing primary camming surfaces, each extending substantially linearly in a first direction away from an associated one of the recesses;

and wherein the radial distance from the axis of rotation of the rotary gear to a point on any primary camming surface decreases substantially linearly with increased distance from the associated recess.

In the preferred embodiment, each cam follower will be a roller, rotatably mounted to a corresponding jaw member.

In a second aspect, the present invention is a rotary gear substantially as described above, for use in a pivoting-jaw power tong.

In an alternative embodiment of the invention, only two of the primary camming surfaces are of linear orientation. In this embodiment, the two primary camming surfaces in question will be diametrically opposed, such that each of them will be engaged by one of the cam followers when the rotary gear is rotated in a particular direction; in other words, they will both be disposed either clockwise of the neutral recesses, or counterclockwise of the recesses.

BRIEF DESCRIPTION OF THE DRAWINGS

Embodiments of the present invention will now be described with reference to the accompanying figures, in which numerical references denote like parts, and in which.

DETAILED DESCRIPTION OF THE PREFERRED EMBODIMENT

Figure 1:
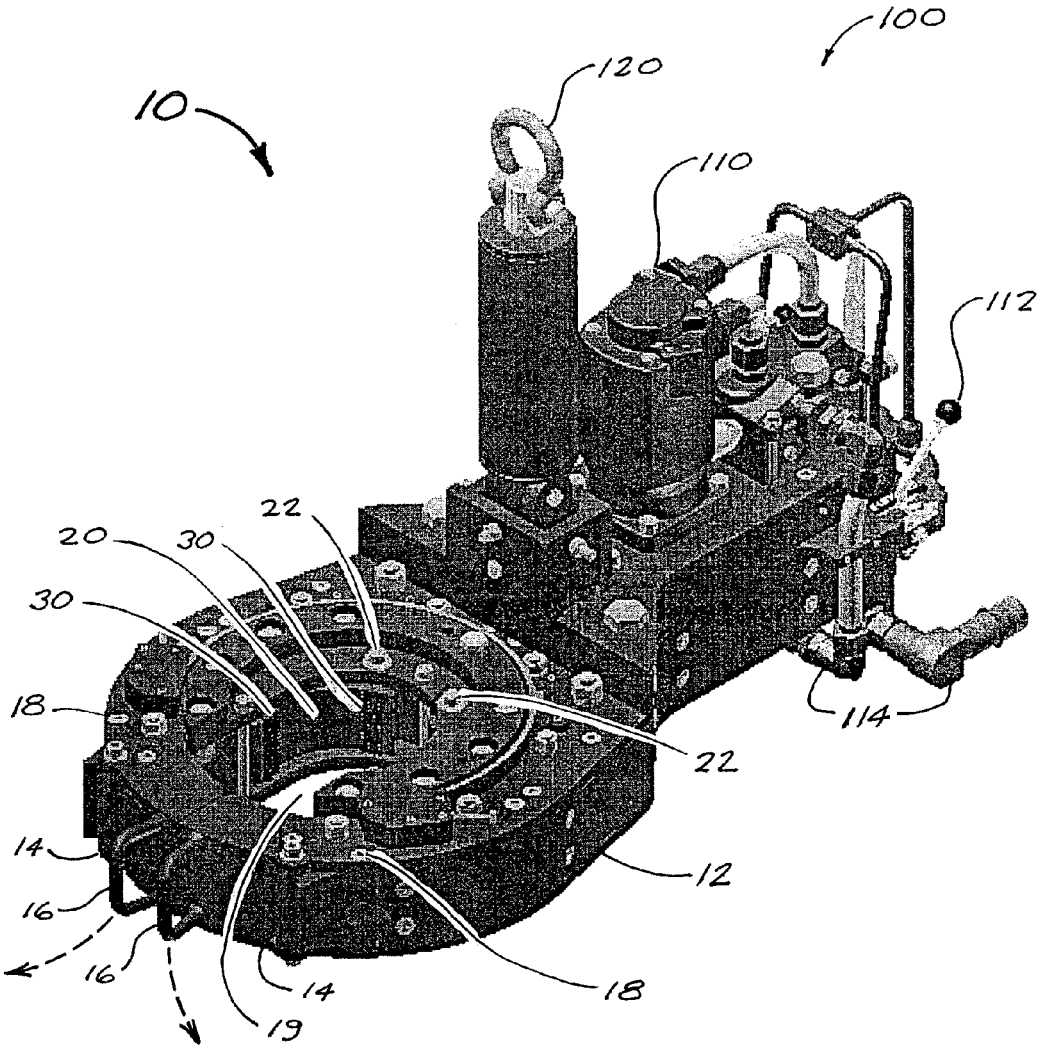
FIG. 1 is an isometric view of a power tong in accordance with an embodiment of the present invention, shown with the rotary gear in the neutral position such that a tubular can pass through the throat opening when the hinged doors have been opened.
Figure 5:
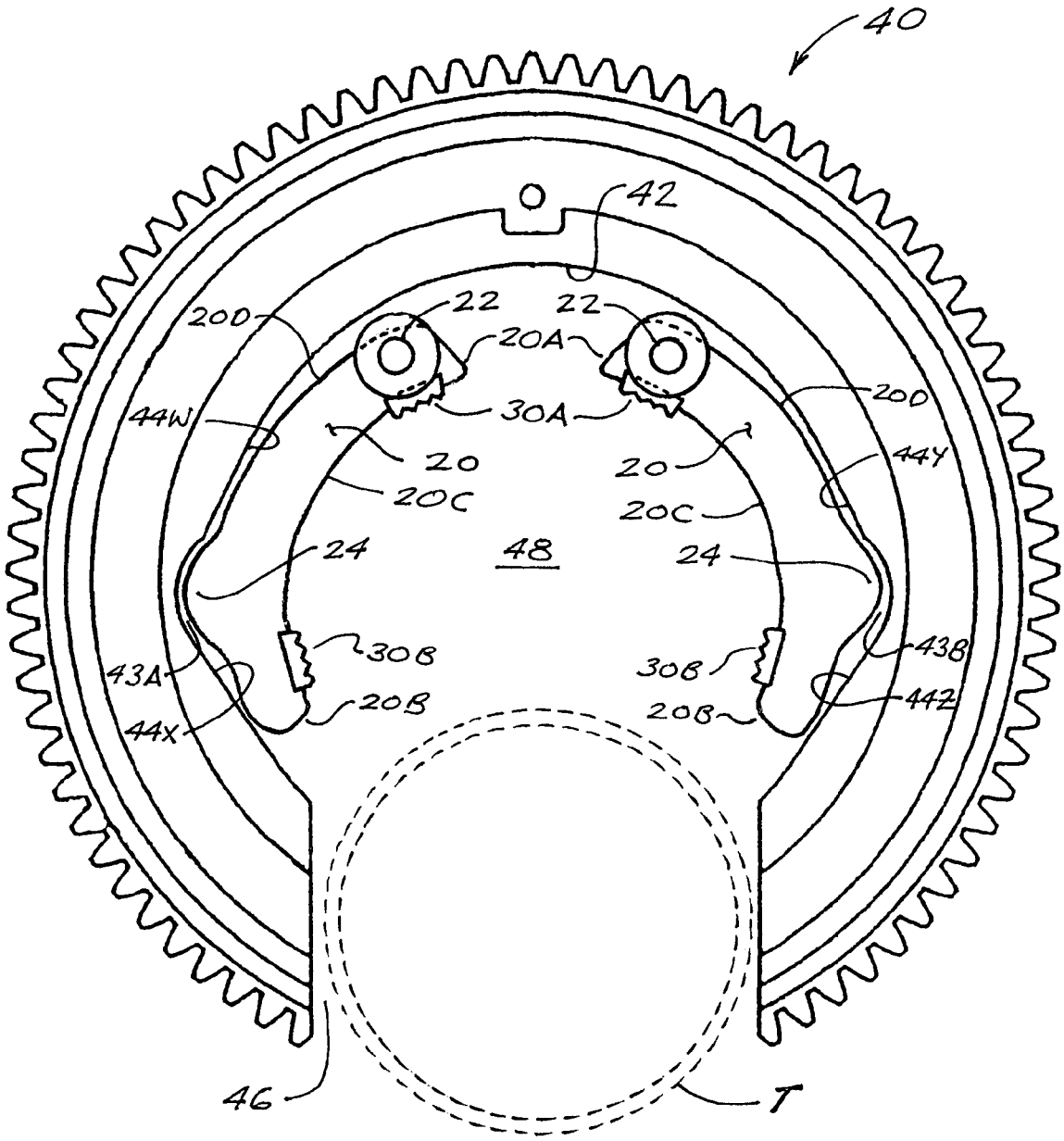
FIG. 5 is a plan view of the rotary gear and pivoting jaws of a power tong in accordance with one embodiment of the invention, shown with the rotary gear in the open position in which a tubular can pass through the throat of the rotary gear and into position between the pivoting jaws.

FIG. 1 generally illustrates an assembled power tong 10 in accordance with one embodiment of the present invention. With the exception of the configuration of the camming surfaces of the rotary gear (which is not visible in FIG. 1), the construction of power tong 10 is largely similar to known power tongs. A generally-C-shaped gear housing 12 has doors 14 which can be swung open about hinge points 18 using handles 16 (as indicated by the broken arrows in FIG. 1) so as to provide an opening into a central space 19 within gear housing 12. A pair of jaw members 20 (typically of generally arcuate shape) are pivotably mounted within gear housing 12. As shown in FIG. 5, each jaw member 20 has a pivot end 20A, a free end 20B, an inner side 20C disposed toward central space 19, and an outer side 20D. The pivot end 20A of each jaw member 20 is pivotably mounted to gear housing 12 by means of a pivot pin 22, at a point opposite the opening into central space 19. Dies 30, for grippingly engaging a tubular, are mounted on the inner sides 20C of each jaw member 20 near each end thereof. Additional features of jaw members 20 are shown in FIGS. 5, 6, and 7, and described in greater detail further on in this specification.

Figure 6:
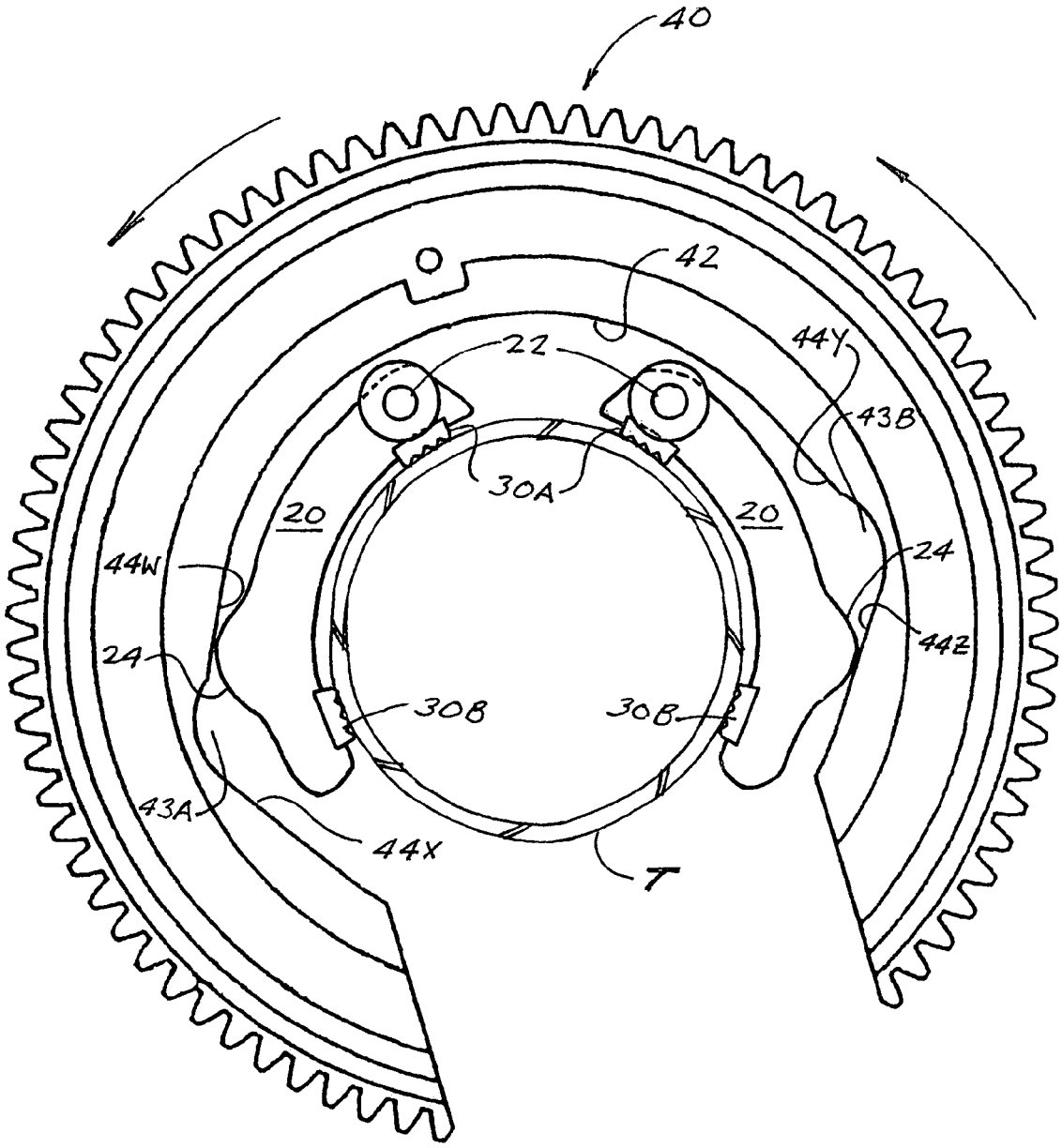
FIG. 6 is a plan view of the rotary gear and pivoting jaws as in FIG. 5, shown with the rotary gear rotated counterclockwise from the neutral position, with a tubular positioned inside the pivoting jaws, and with the jaws' dies beginning to engage and grip the tubular.
Figure 7:
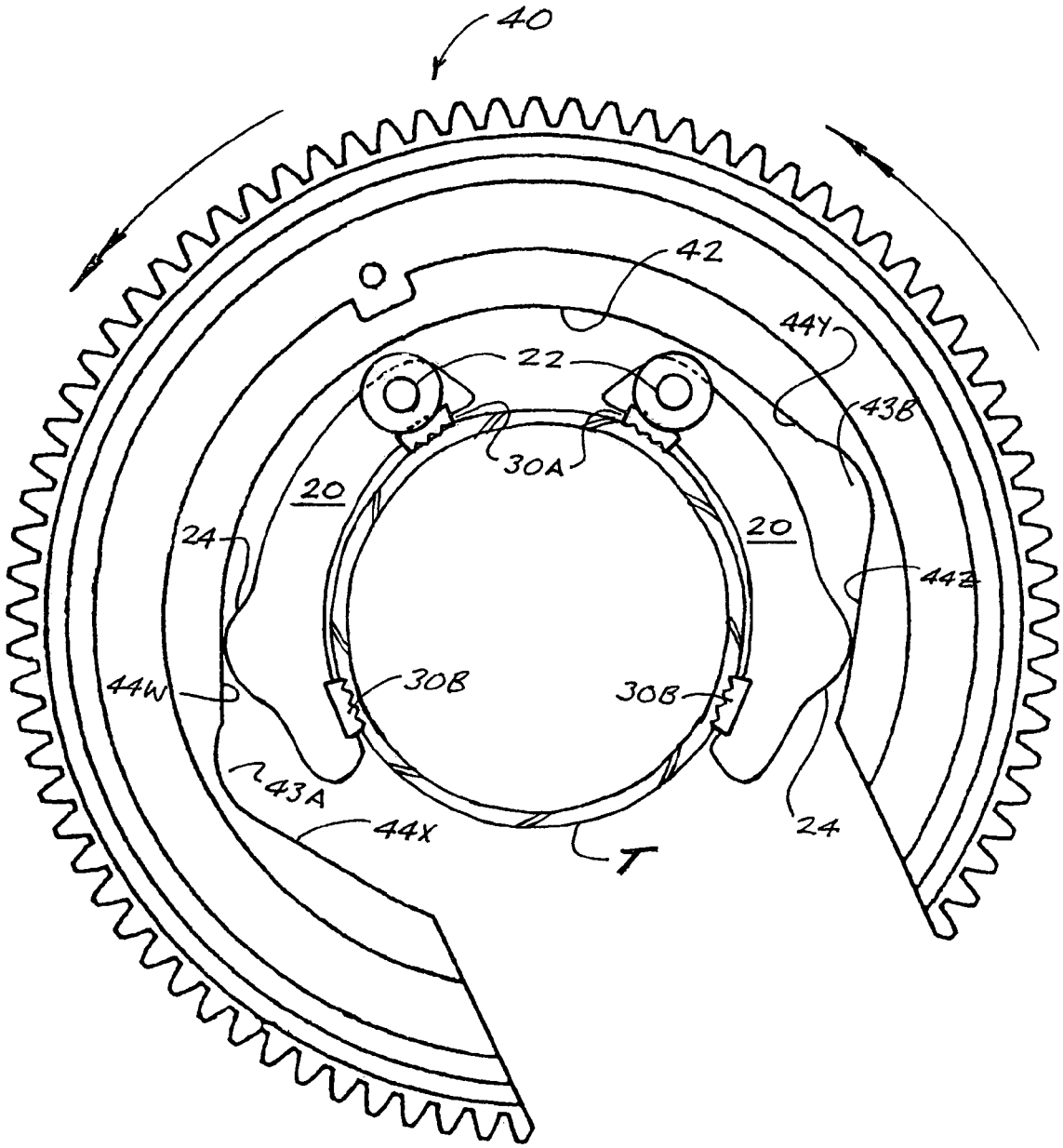
FIG. 7 is a plan view of the rotary gear and pivoting jaws as in FIG. 5, shown with the rotary gear rotated further counterclockwise, with the front pair of dies securely engaging and gripping the tubular.

Disposed within gear housing 12 (but not shown in FIG. 1) is a generally C-shaped rotary gear 40, exemplary embodiments of which are is illustrated in FIGS. 2–7. Rotary gear 40 has a circular perimeter with a plurality of gear teeth 41. Rotary gear 40 also has an inner surface 42 which encloses a central space 48 of sufficient size to enclose jaw members 20 without interference. The perimeter of rotary gear 40 is interrupted by a throat opening 46 which provides access to central space 48. Rotary gear 40 is mounted within gear housing 12 so as to surround jaw members 20 (as best seen in FIGS. 5–7), and so as to be rotatable within gear housing 12 about center axis C of rotary gear 40. The power tong 10 includes means for rotating rotary gear 40, and such means may be of any suitable type well known in the field of the invention. For exemplary purposes, FIG. 1 illustrates power tong 10 with hydraulic actuation means 100, comprising a hydraulic motor 110 which rotates a pinion gear (not shown) that engages gear teeth 41 so as to rotate rotary gear 40 clockwise or counterclockwise as desired, by means of hydraulic valve control levers 112. Hydraulic lines 114 lead from hydraulic actuation means 100 to a hydraulic pump (not shown) associated with the drilling rig or service rig on which power tong 10 is being used. FIG. 1 also illustrates a lifting ring 120 of a type that may be used for suspending power tong 10 from the rig's hoist.

Figure 2:
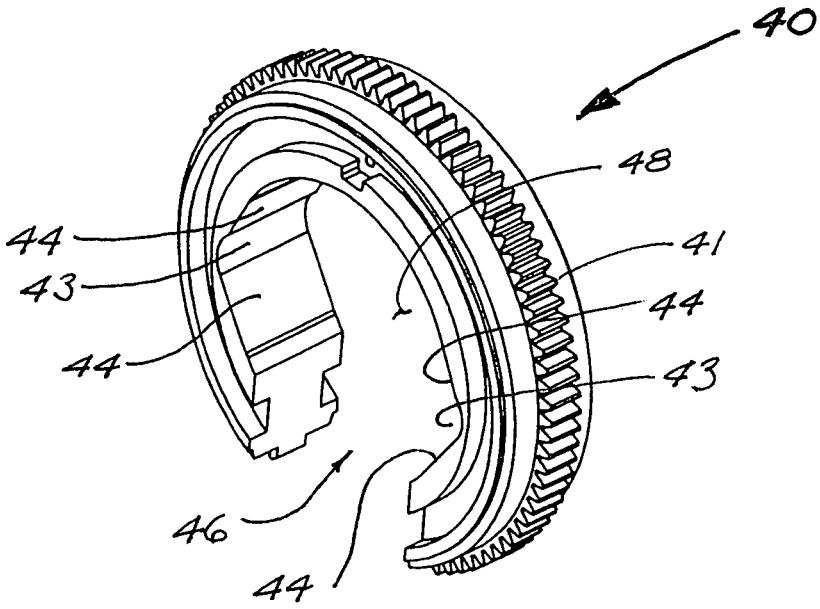
FIG. 2 is a perspective view of the rotary gear of a power tong in accordance with one embodiment of the invention.
Figure 3:
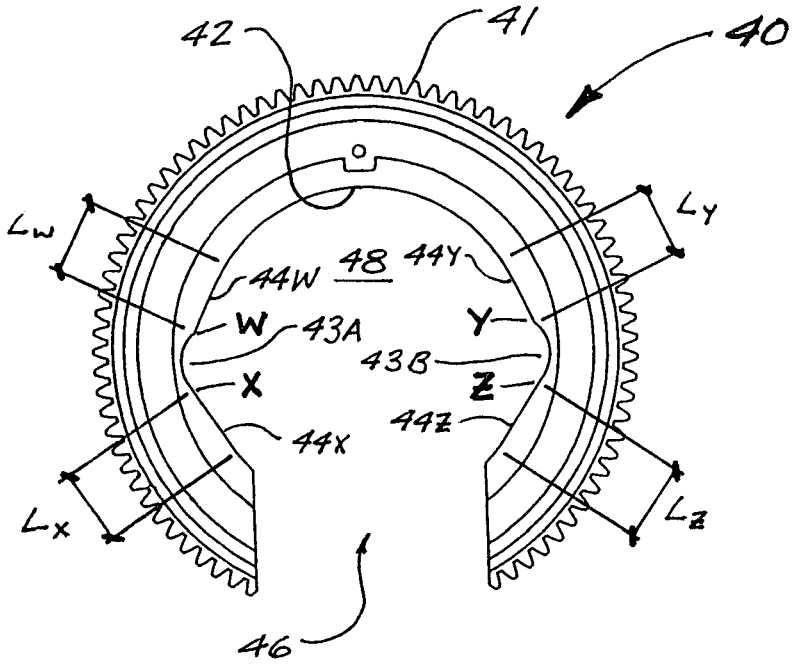
FIG. 3 is a plan view of the rotary gear of FIG. 2.

The three-dimensional configuration of rotary gear 40 is illustrated in FIG. 2. As shown in plan view in FIG. 3, inner surface 42 is of a generally circular configuration, but includes several geometrically distinct portions. If rotary gear 40 as illustrated in FIG. 3 is analogized to a clock face, with throat opening 46 at approximately six o'clock, a first neutral recess 43A is formed in inner surface 42 at approximately nine o'clock, and a second neutral recess 43B is formed in inner surface 42 at approximately three o'clock. The purpose of these neutral recesses will be explained later in this document.

First neutral recess 43A is contiguous with inner surface 42 at points W and X, and second neutral recess 43B is contiguous with inner surface 42 at points Y and Z. Inner surface 42 includes substantially linear (i.e., substantially planar) primary camming surfaces 44W, 44×, 44Y, and 44Z which propagate away from transition points W, X, Y, and Z respectively, as shown in FIG. 3. Primary camming surfaces 44W, 44×, 44Y, and 44Z are indicated in FIG. 3 as having lengths $L_W$, $L_X$, $L_Y$, and $L_Z$ respectively. The magnitude of these lengths will be dependent on the particular requirements of a given power tong 10.

Figure 4:
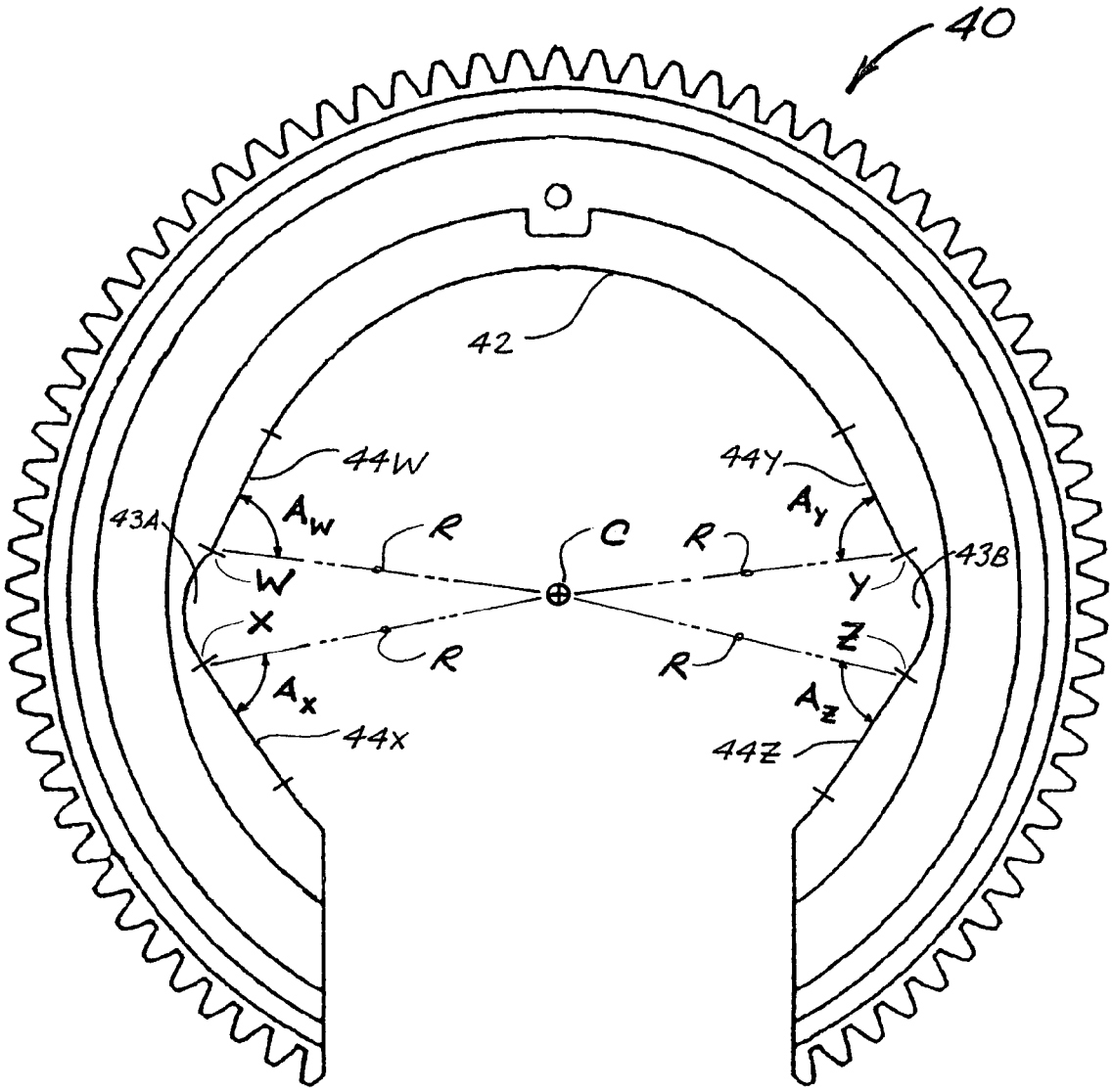
FIG. 4 is an enlarged plan view of the rotary gear of FIG. 2, illustrating the geometric configuration of the camming surfaces.

The geometric characteristics of primary camming surfaces 44W, 44×, 44Y, and 44Z are illustrated in FIG. 4. A radial line R extending from center axis C to transition point W, X, Y, or Z will form an acute angle ($A_W$, $A_X$, $A_{Y,\ or\ AZ}$) with the corresponding primary camming surface 44W, 44×, 44Y, or 44Z. By virtue of this geometric characteristic, the radial distance from center axis C to a point on a given primary camming surface decreases in substantially linear fashion according to the distance away from the corresponding transition point. Acute angles $A_W$, $A_X$, $A_Y$, or $A_Z$ will typically be between eighty and ninety degrees, but the precise magnitude of these angles will be determined to suit the particular requirements of a given application (including, for example, the size of tubular T on which the power tong 10 is to be used).

FIGS. 5, 6, and 7 illustrate rotary gear 40 with jaw members 20 disposed within central space 48, and within gear housing 12 (the components of which are omitted from FIGS. 5, 6, and 7 for clarity). As previously mentioned, the pivot end 20A of each jaw member 20 pivots about a pivot pin 22 mounted to gear housing 12 at a point generally opposite throat opening 46. Each jaw member 20 has a cam-following element (or cam follower) 24 associated with outer side 20D. In the embodiments shown in FIGS. 5, 6, and 7, cam followers 24 are provided in the form of protuberances formed integrally with jaw members 20. Alternatively, cam followers 24 may be in the form of rollers rotatably mounted to their corresponding jaw members 20 using suitable axles or pivot pins. In any event, jaw members 20, cam followers 24, inner surface 42, and neutral recesses 43A and 43B are configured and arranged such that jaw members 20 can pivot outward into an open position (as illustrated in FIG. 5) in which each cam follower 24 is disposed within a corresponding neutral recess (43A or 43B), and in which a tubular T can pass through throat opening 46 of rotary gear 40 into central space 48, and so as to be substantially concentric with center axis C of rotary gear 40.

The basic operation of the power tong 10 may be understood with reference to FIGS. 6 and 7. In FIG. 6, with a tubular T positioned between jaw members 20, rotary gear 40 has been rotated counterclockwise (as indicated by the curved arrows) relative to jaw members 20 (and relative to gear housing 12). The rotation of rotary gear 40 has forced cam followers 24 out of their corresponding neutral recesses 43A and 43B, such that they engage opposing primary camming surfaces $\mathbf{44}_W$ and $\mathbf{44}_Z$. As a result, the free ends 20B of jaw members 20 have rotated inward to the point that dies 30A and 30B have begun to engage the cylindrical outer surface of tubular T. Because primary camming surfaces $\mathbf{44}_W$ and $\mathbf{44}_Z$ are of linear (or planar) configuration as previously described, further counterclockwise rotation of rotary gear 40 causes further inward rotation of jaw members 20 such that dies 30A and 30B bite into tubular T as shown in FIG. 7. Tubular T is thus securely gripped by jaw members 20, thereby facilitating rotation of tubular T relative to an adjoining tubular.

In similar fashion, clockwise rotation of rotary gear 40 (from the open position) would cause cam followers 24 to engage opposing linear primary camming surfaces $\mathbf{44}_X$ and $\mathbf{44}_Y$.

In the embodiment described above, inner surface 42 of rotary gear 40 defines linear primary camming surfaces adjacent to each neutral recess. Alternative embodiments may have only one opposing pair of linear primary camming surfaces (i.e., $\mathbf{44}_W$ and $\mathbf{44}_Z$, or $\mathbf{44}_X$ and $\mathbf{44}_Y$), with the other opposing pair of camming surfaces being of a different configuration (e.g., curved).

It will be readily appreciated by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A rotary gear, for use in a power tong having:

(a) a gear housing defining a central space, and a perimeter opening into said space; and (b) a pair of opposing jaw members disposed within said central space, each jaw member having:

b.1 a pivot end, a free end, an inner side, and an outer side, with said pivot end pivotably mounted to the gear housing, and said free end oriented toward said perimeter opening;

b.2 a pair of dies associated with said inner side; and b.3 a cam follower associated with said outer side;

said rotary gear being rotatably mountable within the gear housing, and having:

(c) a circular perimeter with a plurality of gear teeth;

(d) an inner surface defining a central space large enough to enclose said jaw members; and (e) a throat opening in said perimeter;

wherein said inner surface defines:

(f) a pair of opposed neutral recesses; and (g) a first pair of opposing primary camming surfaces, each extending substantially linearly in a first direction away from an associated one of the recesses;

and wherein the radial distance from the axis of rotation of the rotary gear to a point on any primary camming surface decreases substantially linearly with increased distance from the associated recess.

2. A power tong having:

(a) a gear housing defining a central space, and a perimeter opening into said space; and (b) a pair of opposing jaw members disposed within said central space, each jaw member having:

b.1 a pivot end, a free end, an inner side, and an outer side, with said pivot end pivotably mounted to the gear housing, and said free end oriented toward said perimeter opening;

b.2 a pair of dies associated with said inner side; and b.3 a cam follower associated with said outer side;

(c) a rotary gear rotatably mounted within the gear housing, and having:

c.1 a circular perimeter with a plurality of gear teeth;

c.2 an inner surface defining a central space large enough to enclose said jaw members; and c.3 a throat opening in said perimeter;

wherein said inner surface defines:

(d) a pair of opposed neutral recesses; and (e) a first pair of opposing primary camming surfaces, each extending substantially linearly in a first direction away from an associated one of the recesses;

and wherein the radial distance from the axis of rotation of the rotary gear to a point on any primary camming surface decreases substantially linearly with increased distance from the associated recess.

3. The rotary gear of claim 1, further comprising a second pair of opposing primary camming surfaces, each extending substantially linearly in a second direction away from an associated one of the recesses.

4. The power tong of claim 2, further comprising a second pair of opposing primary camming surfaces, each extending substantially linearly in a second direction away from an associated one of the recesses.

5. The power tong of claim 2 wherein the cam followers are rollers.

6. The power tong of claim 2 wherein the cam followers are protuberances formed integrally with their associated jaw members.

7. The power tong of claim 2, further comprising means for rotating the rotary gear within the gear housing.

8. The power tong of claim 7 wherein the rotating means comprises a hydraulic motor for rotating a pinion gear engaged with the perimeter gear teeth of the rotary gear.

* * * * *